United States Patent [19]

Ichioka

[11] Patent Number: 4,685,536

[45] Date of Patent: Aug. 11, 1987

[54] ELEVATOR GROUP SUPERVISION APPARATUS

[75] Inventor: Youichi Ichioka, Tokyo, Japan

[73] Assignee: Mitsubishi Denki Kabushiki Kaisha, Japan

[21] Appl. No.: 865,972

[22] Filed: May 22, 1986

[30] Foreign Application Priority Data

May 28, 1985 [JP] Japan ..... 60-114619

[51] Int. Cl.[4] ..... B66B 1/16

[52] U.S. Cl. ..... 187/101; 187/124

[58] Field of Search ..... 187/100, 101, 124

[56] References Cited

U.S. PATENT DOCUMENTS 4,114,730 9/1978 Means et al. ..... 187/101
4,266,632 5/1981 Yoneda et al. ..... 187/124
4,473,133 9/1984 Enriquez et al. ..... 187/101

FOREIGN PATENT DOCUMENTS 59-138576 8/1984 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

The respective status signals of an existing relay type elevator and an electronic elevator are loaded by a group-supervisory computer, together with hall call signals, and operation commands according to which the elevators are to respond to the hall call signals are generated and sent to the existing relay type elevator and the electronic elevator.

Consequently, even in a case where one or more elevators in a relay type elevator group in operation has/-have been replaced with an electronic elevator or electronic elevators, the service of elevator group supervision is prevented from lowering. Moreover, the group supervision service can be enhanced by increasing the use of an electronic elevator already and combining it with relay type elevators in operation.

8 Claims, 8 Drawing Figures

ELEVATOR GROUP SUPERVISION APPARATUS

BACKGROUND OF THE INVENTION

This invention relates to an elevator group supervision apparatus which is utilized in case of changing or increasing the number of elevator cars.

With the progress of computer technology, electronically-operated elevators have appeared and are coming into wide use. The electronically-operated elevator uses computers for both a group-supervisory device and an elevator control device as shown in FIG. 1 of the official gazette of Japanese Patent Application Laid-open No. 59-138576.

In addition, the computer of the group-supervisory device and that of the elevator control device transfer signals through a serial signal transmission processor as well as a communication line.

On the other hand, in buildings already constructed, a large number of relay type elevators which are controlled by relay circuits without employing computers are operating even now. The relay type elevator has a group-supervisory device and an elevator control device which are constructed of relays, and between which parallel signals are transmitted.

In case of changing or increasing an elevator in an existing building, the electronic elevator which is better in performance than the relay type elevator and is spreading rapidly.

Besides, in the group supervision apparatus for electronic elevators as shown in FIG. 1 of the aforementioned official gazette, all the elevators to be group-supervised use computers for the elevator control devices.

Accordingly, when an electronic elevator is to be substituted for one of a plurality of existing relay type elevators or when an electronic elevator is to be included into a single elevator group having at least one existing elevator, an arrangement shown in FIGS. 6A and 6B is employed.

Letter FIG. 6A shows indicates an electronic elevator system, wherein, When a hall call button 1 is depressed, a hall call signal is transmitted through a parallel signal transmission line 2 to the parallel signal transmission processor 3*a* of a group-supervisory computer 3 and is loaded in the group-supervisory computer 3.

In #1 Elevator 5, the status signal of the #1 elevator 5 is transmitted from elevator equipment 8 through a parallel signal transmission line 7 to the parallel signal transmission processor 6*b* of a computer 6.

This status signal is transmitted to the serial signal transmission processor 6*a* of the computer 6, in which it is converted and processed into a serial signal. The serial signal is sent through a serial signal transmission line 4 to the serial signal transmission processor 3*b* of the group-supervisory computer 3, whereby the status signal of the #1 elevator 5 is loaded in the group-supervisory computer 3.

Thus, the group-supervisory computer 3 performs the service operation control of the elevator so as to respond to a hall call on the basis of the hall call signal and the status signal of the #1 elevator.

Letter B in FIG. 6 indicates a relay type elevator system already installed, in which #2 Elevator 9 is an existing relay type elevator. By depressing a hall call button 10, a hall call signal is sent to a relay-system group-supervisory device 11 and then to the relay-system elevator control device 9*a* of the #2 elevator 9. The drive control of elevator equipment 9*b* is performed by the relay-system elevator control device 9*a*.

As seen from the arrangement of FIG. 6, the group-supervisory device for the electronic elevator in the prior art can be connected to only the elevator control device employing the computer by the serial signal transmission and cannot be connected to the existing relay type elevator 9 in the system B.

Accordingly, the electronic elevator installed or increased anew and the relay type elevator installed before cannot be group-supervised as a single group, and group supervisions independent of each other must be performed by disposing the two sets of hall call buttons 1 and 10 and establishing the divided elevator groups of the electronic elevator and the relay type elevator as illustrated in FIG. 6. Besides, in the case where each elevator group includes one elevator and both the groups include two elevators in total just as depicted in FIG. 6, each elevator must be operated singly.

Therefore, in a case where an existing relay type elevator group has been partly replaced with one or more electronic elevators, the elevator group incurs a lowering in service.

With the prior art, it is impossible to include an electronic elevator and operate it in association with existing relay type elevators so as to enhance the group supervision service.

SUMMARY OF THE INVENTION

This invention has been made in order to solve such problems, and has for its object to provide an elevator group supervision apparatus in which an electronic elevator installed anew by replacement or increase and relay type elevators installed before can be collectively group-supervised by a group-supervisory computer built in the electronic elevator, so that the enhancement of group supervision service is permitted.

The elevator group supervision apparatus according to this invention comprises means to transfer signals with a control device of an existing relay type elevator, means to transfer signals with an elevator control computer of a replacing or increased electronic elevator, and a group-supervisory computer which controls both the control devices.

In this invention, the group-supervisory computer loads hall call signals, the status signal of the existing relay type elevator and the status signal of the electronic elevator, determines the elevators to respond to the hall calls and transmits operation commands to the existing relay type elevator and the electronic elevator.

BRIEF DESCRIPTION OF THE DRAWINGS

In the drawings, the same symbols indicate identical or corresponding portions.

DESCRIPTION OF THE PREFERRED EMBODIMENT

Figure 1:
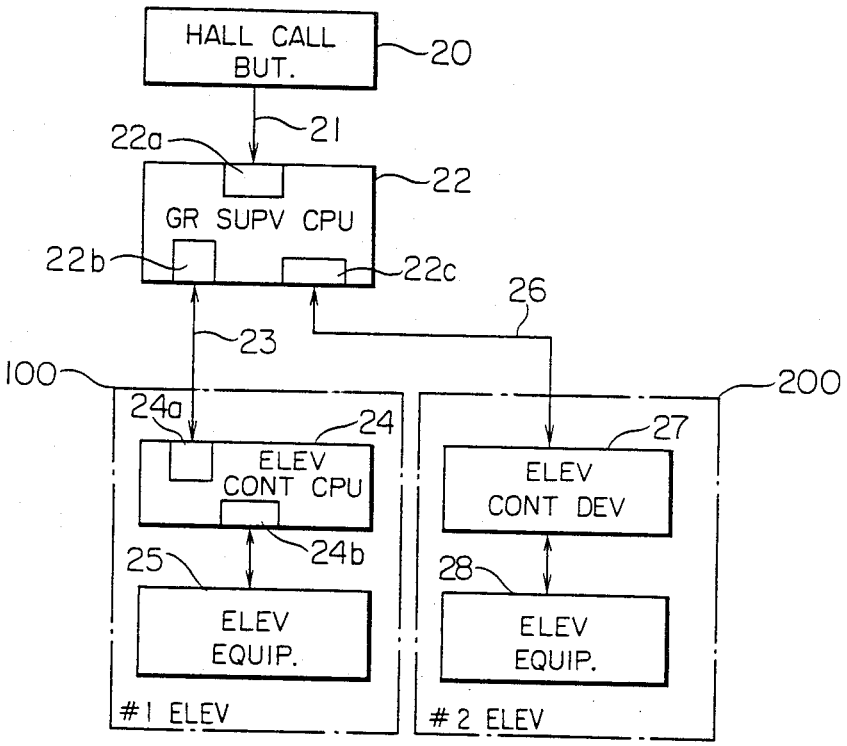
FIG. 1 is a block diagram showing an embodiment of an elevator group supervision apparatus according to this invention.

Now, an embodiment of an elevator group supervision apparatus according to this invention will be described with reference to the drawings. FIG. 1 is a block diagram showing the arrangement of the embodiment. The embodiment of FIG. 1 is an example in the case where one elevator is replaced with an electronically-operated elevator or one electronically-operated elevator is included, and the elevator installed anew is combined with one relay-operated elevator installed before, so as to group-supervise the two elevators.

In FIG. 1, numeral 100 designates #1 Elevator, and numeral 200 designates #2 Elevator. The #1 elevator 100 is the electronic elevator (i.e. the replacing or increased elevator), and the #2 elevator 200 is the relay type elevator previously installed.

Numeral 20 indicates hall call buttons common to the #1 elevator 100 and the #2 elevator 200. The hall call buttons 20 are connected through a parallel signal transmission line 21 to the parallel signal input/output processor 22*a* of a group-supervisory computer 22.

The serial signal transmission processor 22*b* of the group-supervisory computer 22 is connected through a serial signal transmission line 23 to the serial signal transmission processor 24*a* of an elevator control computer 24.

This elevator control computer 24 is disposed within the #1 elevator 100, and the parallel signal input/output processor 24*b* thereof transfers data between it and elevator equipment 25.

This elevator equipment 25 corresponds to the cage and door of the #1 elevator 100 and devices for driving and controlling them.

Further, the group-supervisory computer 22 includes a parallel signal input/output processor 22*c*, which is connected through a parallel signal input/output line 26 to the elevator control device 27 of the #2 elevator 200. The elevator control device 27 transfers data with elevator equipment 28. This elevator control device 27 is constructed of relays.

Likewise to the elevator equipment 25, the elevator equipment 28 corresponds to the cage and door of the #2 elevator 200 and devices for driving and controlling them.

Next, the operation of the embodiment in FIG. 1 will be described. When the hall call button 20 is depressed, a hall call button signal is input to the parallel signal input/output processor 22*a* of the group-supervisory computer 22 through the parallel signal transmission line 21 and is loaded in the group-supervisory computer 22.

At this time, the elevator control computer 24 has the status signal of the #1 elevator 100 supplied to the parallel signal input/output processor 24*b* from the elevator equipment 25. This signal is delivered to the serial signal transmission processor 24*a*, in which it is converted into a serial signal. Thereafter, the serial signal is sent through the serial signal transmission line 23 to the serial signal transmission processor 22*b* of the group-supervisory computer 22.

Thus, the group-supervisory computer 22 loads the status signal of the #1 elevator 100.

Similarly, the status signal of the #2 elevator 200 from the elevator equipment 28 is sent to the elevator control device 27 and is input to the parallel signal input/output processor 22*c* through the parallel signal input/output line 26 by this elevator control device 27. Then, the group-supervisory computer 22 loads the status signal of the #2 elevator 200.

In this manner, the group-supervisory computer 22 detects the hall calls of the hall call buttons 20 and determines which elevators are to respond to the hall calls. As regards the #1 elevator 100, the group-supervisory computer 22 sends an operation command according to which the elevator executes the operation of responding to the corresponding hall call, to the serial signal transmission processor 24*a* of the elevator control computer 24 through the serial signal transmission processor 22*b* as well as the serial signal transmission line 23.

On the other hand, as regards the #2 elevator 200, the group-supervisory computer 22 sends an operation command for the execution of the operation of responding to the corresponding hall call, to the elevator control device 27 through the parallel signal input/output processor 22*c* as well as the parallel signal input/output line 26.

Figure 2:
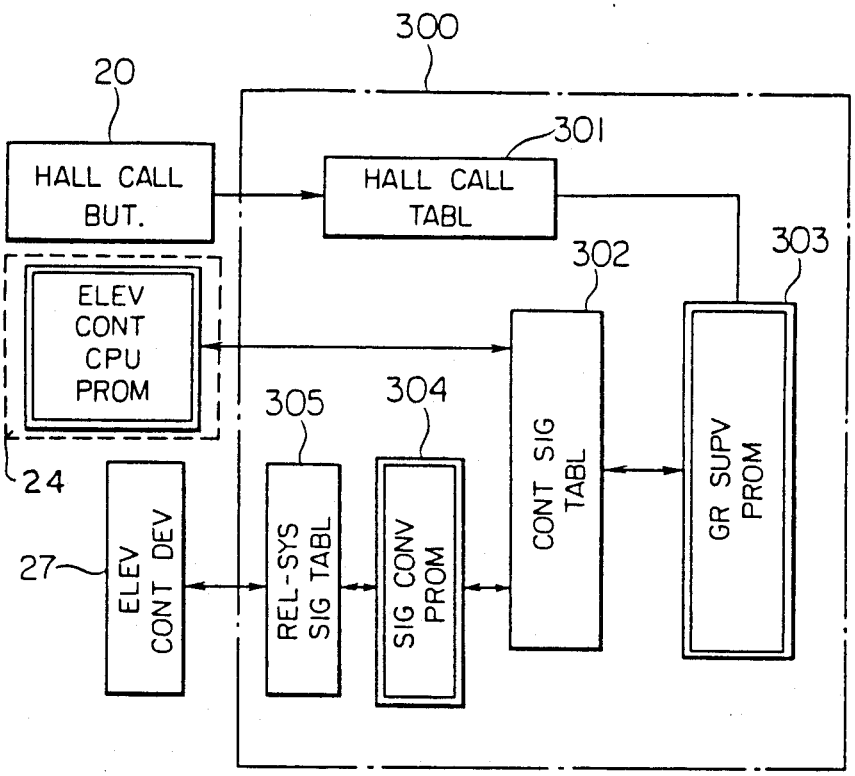
FIG. 2 is a diagram showing the program setup of a group-supervisory computer in the elevator group supervision apparatus.

FIG. 2 is a diagram showing the setup of the programs of the group-supervisory computer 22 in the embodiment. In the program setup of FIG. 2, numeral 300 designates a group-supervisory computer program, in which a hall call table 301 serves to once store the hall call button signals generated by depressing the hall call buttons 20.

In addition, a control signal table 302 serves to store the elevator status signals of the respective elevators required by an elevator group supervision program 303 and the operation command signals for operating the elevators.

The group supervision program 303 loads the hall call button signals stored in the hall call signal table 301 and the respective elevator status signals stored in an elevator signal table within the control signal table 302, and delivers the operation command signals of the respective elevators obtained by subsequent calculations, to the elevator signal table within the control signal table 302 so as to store them therein.

The elevator status signal and the elevator operation command signal of the elevator signal table are transferred to the electronic elevator such as the #1 elevator 100, and the elevator control computer which is structurally left intact, whereby the #1 elevator is group-supervised. In contrast, when the function of the elevator control device 27 of the relay type elevator for controlling the #2 elevator 200 and that of the elevator control computer are different as are often the case, the elevator status signal and the elevator operation command signal stored in the control signal table 302 cannot be directly transferred to the elevator control device 27 of the #2 elevator 200.

Accordingly, a signal conversion program 304 is used to once load the signal from the elevator control device 27 of the #2 elevator 200 into a relay-system signal table 305 and to create the same elevator status signal as that of the #1 elevator 100 from the loaded signal, the created signal being stored in the control signal table 302. The signal conversion program 304 is also used to convert the operation command signal for the #2 elevator in the control signal table 302 into an operating relay signal for group-supervising the #2 elevator, the converted signal being delivered to the relay-system signal table 305 and transmitted to the elevator control device 27.

Figure 3A:
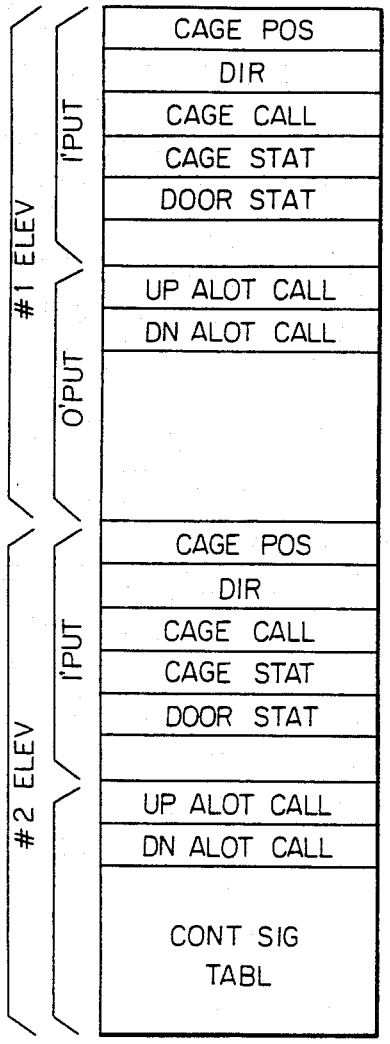
FIG. 3(*a*) is a diagram showing the format of a control signal table in the program setup of FIG. 2, while FIG. 3(*b*) is a diagram showing the format of a relay-system signal table in the program setup of FIG. 2.
Figure 3B:
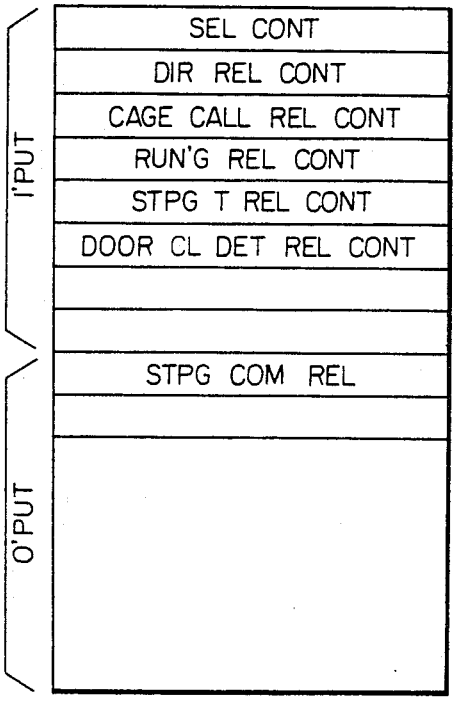

FIG. 3(*a*) shows an example of the format of the control signal table 302, in which an expression "cage status" on the side of the #1 elevator 100 signifies a status as to whether or not the cage is running.

An expression "door status" is a status as to whether or not the door of the #1 elevator is closed. An expression "up allotted call" signifies that the hall call is in the ascending direction to which the #1 elevator 100 is to respond, while an expression "down allotted call" signifies that the hall call is in the descending direction to which the #1 elevator 100 is to respond.

Figure 4:
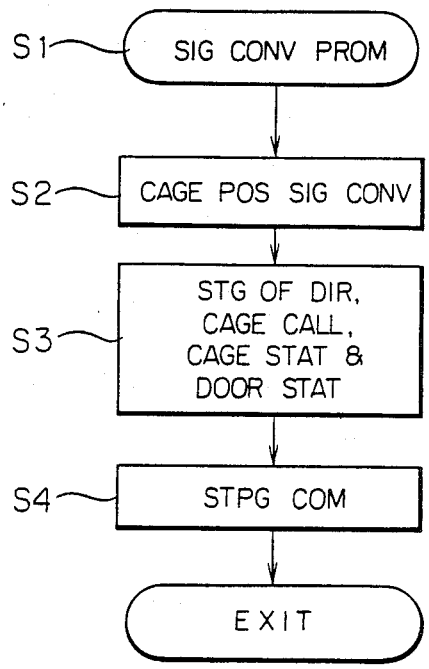
FIG. 4 is a flow chart of a signal conversion program in the program setup of FIG. 2.

FIG. 3(*b*) shows an example of the contents of the relay-system signal table 305, and FIG. 4 is a flow chart of an example of the signal conversion program 304.

Referring to FIG. 4, when the signal conversion program 304 is started, a step S1 loads a selector contact signal, a direction relay contact signal, a running relay contact signal and a stoppage timing relay contact signal stored in the relay-system signal table 305 as shown in FIG. 3(*b*), and it is followed by cage position signal conversion in which the information of the cage position (FIG. 3(*a*)) is stored in the part of the control signal table 302 corresponding to the cage position of the #2 elevator 200 (a step S2).

Figure 5:
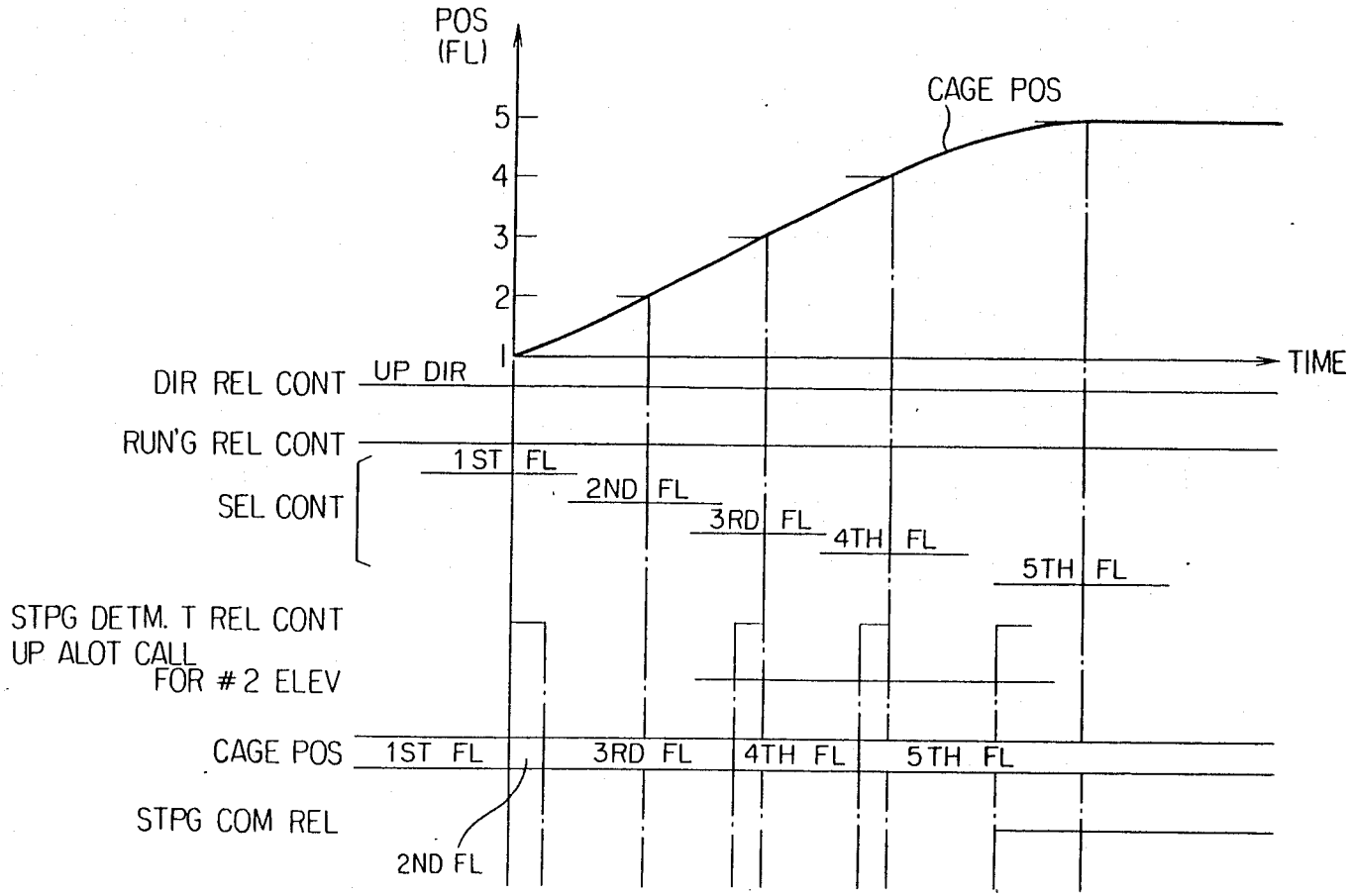
FIG. 5 is a diagram for explaining the operations of a cage position signal conversion and a stoppage command in the elevator group supervision apparatus.
Figure 6A:
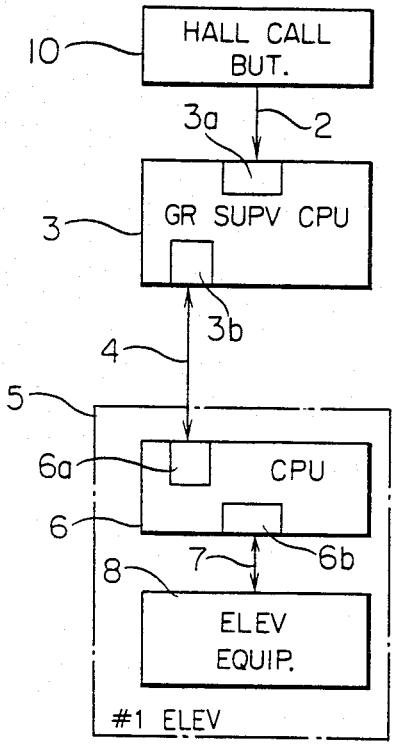
FIG. 6A PRIOR ART
FIGS. 6A and B are block diagrams showing an elevator group supervision apparatus in a prior art.
Figure 6B:
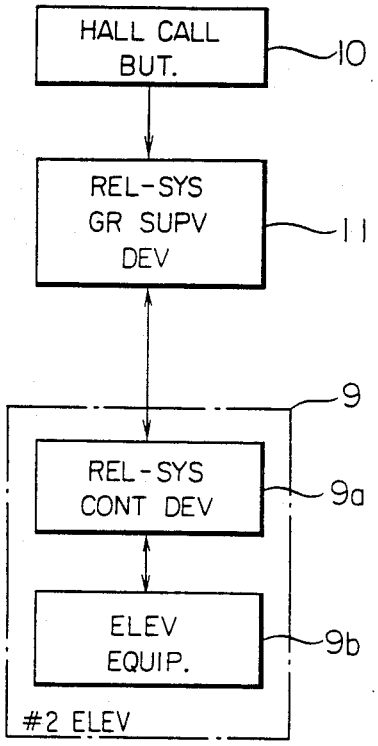
FIG. 6B PRIOR ART

The operation of cage position signal conversion is illustrated in FIG. 5. This operating example corresponds to a case where the cage of the #2 elevator runs from the first floor to the fifth floor.

The cage position becomes the second floor when the running relay contact signal has been detected Subsequently, when the stoppage determinant timing relay contact signal has been detected to turn from being significant into being insignificant, the cage position is advanced to the third floor subject to the absence of a stoppage command relay signal.

Thenceforth, in a similar procedure, it is detected that the stoppage determinant timing relay contact signal has turned from being significant into being insignificant, and the cage position is advanced to the fourth floor in the absence of the stoppage command relay output signal.

When the cage position is the fourth floor, the stoppage command relay signal exists at the point of time at which the stoppage determinant timing relay contact signal turns from being significant into being insignificant, so that the cage position cannot be advanced.

On the fifth floor, the selector contact signal becomes the fifth floor, and it is checked that the cage position agrees with this floor.

At the next step S3 of the program 304, direction, cage call, cage status and door status signals are generated from the direction relay contact signal, cage call contact signal, running relay contact signal and door closure detecting relay contact signal, and they are stored in the control signal table 302 as the elevator status signals of the #2 elevator.

Further, at a step S4, the program executes the stoppage command of loading the allotted call which is one of the operation commands of the control signal table 302, determining the stoppage relay signal from the direction relay contact signal and stoppage timing relay contact signal of the relay-system signal table 305 and storing the determined signal in the relay-system signal table.

An operating example of the stoppage command will be explained with reference to FIG. 5. It is assumed that the cage is running in the ascending direction from the first floor. It is also assumed that an allotted call in the ascending direction for the fifth floor is entered. Then, when the cage position has become the fifth floor and the stoppage determinant timing relay contact signal has turned significant, the stoppage relay signal is turned significant.

As thus far described, the differences between the functions of the relay-system control device and the control program are compensated by the signal conversion program 304, and the control device and the control program can be handled as having no functional difference when viewed from the group supervision program.

The foregoing embodiment has been described as to the elevator group including one electronically-operated elevator and one relay-operated elevator previously installed. However, even in case of a plurality of electronic elevators and a plurality of relay type elevators, this invention can be similarly constructed to realize the same effects.

As described above, this invention consists in that the respective status signals of an existing relay type elevator and an electronic elevator are loaded by a group-supervisory computer, together with hall call signals, and that operation commands according to which of the elevators are to respond to the hall call signals are created from the hall call signals and the status signals and are provided to the existing relay type elevator and the electronic elevator. It is therefore possible to collectively group-supervise the electronic elevator installed anew, due to the replacement of an old one or the crease of a new one, and the relay type elevator already installed.

Consequently, even in a case where one or more elevators in a relay type elevator group operation has/-have been replaced with an electronic elevator or electronic elevators, the service of elevator group supervision is not lowered. Moreover, the group supervision service can be enhanced by increasing an electronic elevator and combining it with relay type elevators in operation.

What is claimed is:

1. In an elevator system wherein an electronic elevator whose cage is controlled by a control device utilizing a computer and a relay type elevator whose cage is controlled by a control device utilizing a relay circuit are juxtaposed, and wherein both the elevators are group-supervised by a single group supervision apparatus, said elevator group supervision apparatus comprising first means connected to said relay circuit control device to transfer signals therebetween, second means electronically connected to said computer-based control device to transfer signals therebetween, and a group-supervisory computer receiving hall call signals, a status signal from said relay circuit control device, and a status signal from said computer-based control device to collectively group-supervise said elevators.

2. An elevator group supervision apparatus according to claim 1, wherein said second means transfers the signals in accordance with a serial transmission system.

3. An elevator group supervision apparatus according to claim 1 wherein said group-supervisory comprises first memory means to store the signals sent from said first means, means to convert the signals stored in said first memory means into a form of signals for use therein, and second memory means to store the signals converted by said conversion means.

4. An elevator group supervision apparatus according to claim 3 wherein said second memory means further stores the signals sent from said computer-based control device.

5. An elevator group supervision apparatus according to claim 4 wherein said group-supervisory computer comprises third memory means to store the hall call signals sent from hall call buttons disposed at respective halls, and executes the group supervision on the basis of status signals from said computer-based control device and status signals from said relay circuit control device stored in said second memory means and said hall call signals stored in said third memory means.

6. An elevator group supervision apparatus according to claim 5 wherein said group-supervisory computer generates a group-supervisory control signal for the relay type elevator, said control signal being converted through said conversion means into a signal form to be supplied to said relay circuit control device.

7. An elevator group supervision apparatus according to claim 6 wherein said converted control signal generated by said group-supervisory computer is stored in said first memory means.

8. An elevator group supervision apparatus according to claim 5 wherein said third memory means utilizes a parallel transmission system to store the hall call signals sent from said hall call buttons.

* * * * *